United States Patent [19]

Pillsbury

[11] 4,246,455

[45] Jan. 20, 1981

[54] CHAIN PULL SOCKETS

[76] Inventor: Richard L. Pillsbury, 14270 Ardel Dr., Lake Park, Fla. 33403

[21] Appl. No.: 50,875

[22] Filed: Jun. 21, 1979

[51] Int. Cl.[3] ..... H01H 17/16

[52] U.S. Cl. ..... 200/51.15

[58] Field of Search ..... 200/51.15, 156, 161

[56] References Cited

U.S. PATENT DOCUMENTS

| | | | |
|---|---|---|---|
| 946,395 | 1/1910 | Paiste | 200/156 X |
| 1,012,240 | 12/1911 | Bowers | 200/51.15 |
| 1,100,253 | 6/1914 | Petit | 200/156 |
| 1,736,285 | 11/1929 | Hubbell | 200/51.15 |

*Primary Examiner*—Stephen Marcus

*Attorney, Agent, or Firm*—Hal H. McCaghren

[57] ABSTRACT

An electric light chain pull socket has an insulator body having two side members supporting an insulator wheel, one flange of which has a contact plate with alternate conductor portion and insulator portion spaced thereon, removable contact conductor members to selectively make or break the circuit by contact with the conductor portion or insulator portion of the contact plate on the flange of the chain pull insulator wheel; and, a chain pull mechanism to rotate the insulator wheel to a predetermined position, and a removable return spring for said chain of said chain pull mechanism.

3 Claims, 10 Drawing Figures

CHAIN PULL SOCKETS

Electric light sockets are old and well known in the art. Chain pull mechanisms for make and break of the circuit are also well known. But such sockets when they malfunction are normally considered unrepairable.

An object of this invention is to provide a chain pull electric light socket which will be sturdy, efficient and long lasting, employing replaceable parts at a minimal cost.

Another object of this invention is to provide a socket of the class described employing a minimum of moving parts, each of which is replaceable at a minimal cost.

A still further object of this invention is to provide a socket of the class described employing durable parts which are replaceable with a minimum of effort and expense.

Referring to the drawings, forming a part hereof, in which.

Figure 1:
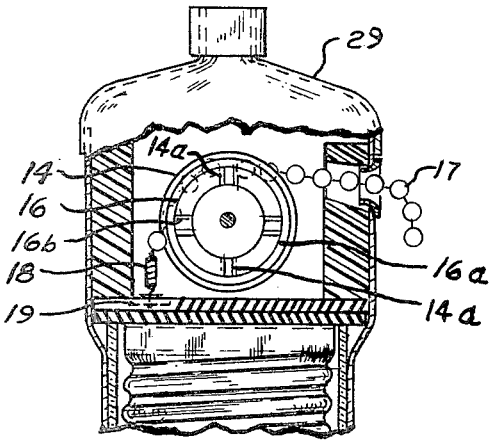
FIG. 1 is a cross sectional side view of the chain pull socket of this invention, with a portion of a housing therefor shown in elevation.
Figure 2:
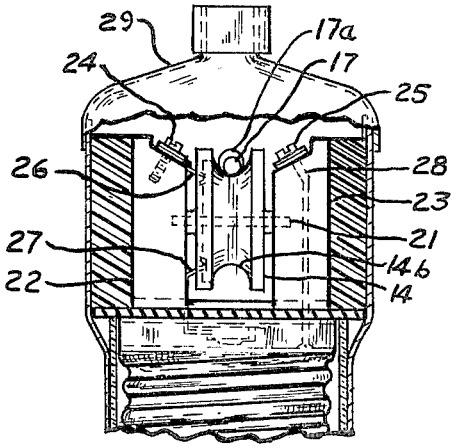
FIG. 2 is a cross sectional end view of the chain pull socket of this invention, with a portion of a housing therefor shown in elevation.
Figure 3:
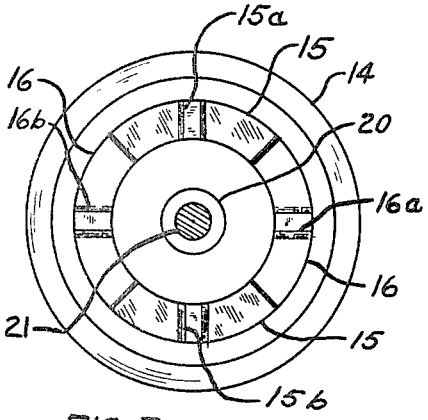
FIG. 3 is a side view of the contact plate on a rotatable insulator wheel flange showing the alternating conductor portions and insulator portions.
Figure 4:
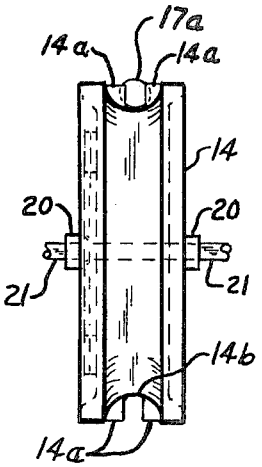
FIG. 4 is an end view of the rotatable chain pull insulator pulley member.
Figure 5:
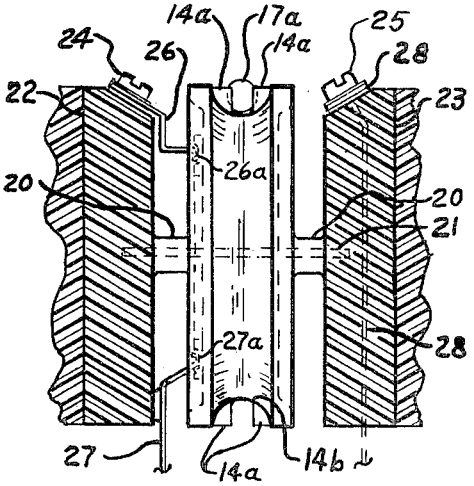
FIG. 5 is an enlarged view of the chain pull rotatable insulator pulley mounted in the two parts insulator body, and showing the removable conductor elements.
Figure 6:
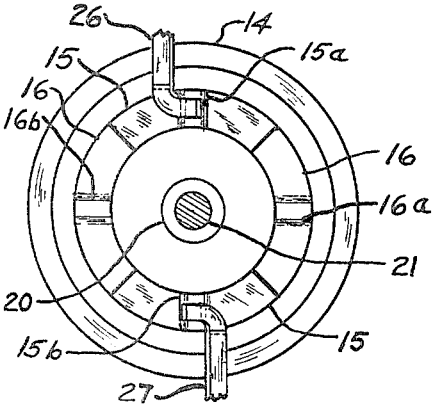
FIG. 6 is a side view of the rotatable insulator pulley wheel showing the conductor contact engaging points for opening and closing, or making and breaking the circuit.
Figure 7:
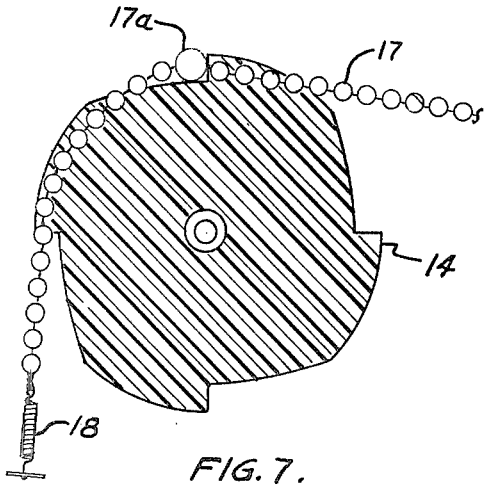
FIG. 7 is a side view of the pull chain mechanism.
Figure 8:
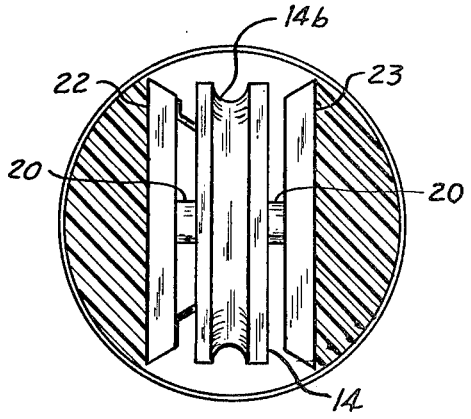
FIG. 8 is a cross sectional view of the insulator body in a housing with the rotatable pulley wheel mounted therein.
Figure 9:
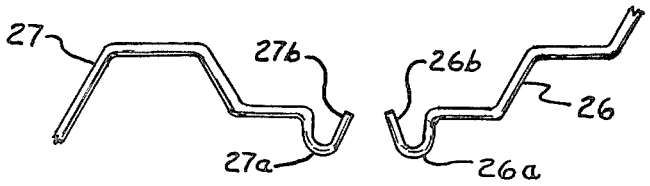
FIG. 9 is a side elevation of the configuration of the contact points.
Figure 10:
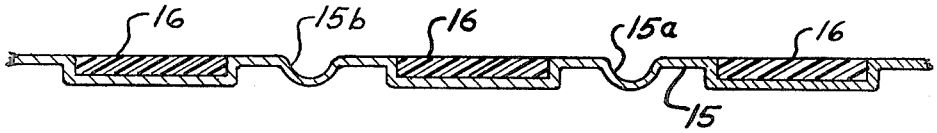
FIG. 10 is an enlarged cross sectional view of a rectilinear representation of the circular conductor ring, showing the conductor member continuous on one side and spaced insulator portions on the other side, with indentations to receive the arcuate configuration portion of the contact points.

Referring to the drawings wherein like members are given the same reference numeral, a rotatable pulley wheel 14 has provided in the central portion thereof a ratchet portion 14*a* with a substantially perpendicular face 14*b* on each of the ratchet tooth portion 14*a*.

A rotatable contact conductor plate 15 is mounted on one flange of the rotatable pulley 14. This contact plate has a plurality of indentation 15*a* and 15*b* for receiving an electrical conductor point. Other portions of the conductor plate have insulation portions 16 interposed between conductor portions 15*a* and 15*b*. These insultation portions are also provided with holding points 16*a* and 16*b*.

To rotatably turn the pull pulley wheel 14, a link chain 17 has spaced thereon an enlarged bead 17*a* to engage the ratchet engaging portion 14*a* to rotate the pulley wheel 14. After rotation, the return spring 18 retracts the chain 17 so that it will be in position for a second movement to alternately position the electrical conductor point over insultation portions 16 and conductor portions 15. The retractable tension spring 18 may be secured to the insulator body in any convenient manner, such as providing a hook or bracket for it to hook over or an imbeded nut to receive a bolt.

The rotatable pulley wheel 14 is preferably provided with spacer hubs 20, which are mounted for free rotation on the shaft 21, as is the rotatable pulley wheel 14.

A positive insulator body member 22 adapted to receive one end of the pulley wheel shaft 21, an opposite negative insulation or body member 23 is adapted to receive the other end of the pulley wheel shaft 21.

In the positive insulator body member 22 there is imbeded an internally screw threaded member to receive a threaded bolt 24, and on the negative insulator body member 23 there is provided a internally threaded member to receive a bolt 25. On the positive insulator body member 22 there may be positioned a second positive member bolt assembly.

Two positive contact conductor points 26 and 27 are operably connected to the positive terminal connectors bolt 24. The positive contact conductor points are of a configuration to effect an arcuate portion 26*a* and 27*a* near the free ends thereof, 26*b* and 27*b* respectively. These arcuate portions 26*a* and 27*a* mate with the holding points 15*a* and 15*b* of the conductor in the rotatable contact plate and also in the insulation portion.

In the negative terminal block 23 there is imbeded a conductor 28 which is provided with a screw thread conductor terminal bolt 25.

This mechanism is housed in a conventional lamp socket housing 29 with the usual internal insulator member.

The number of ratchet teeth 14*a* on the rotatable pulley wheel 14 coincide with the number of conductor portions 15 and insulation portions 16; so that so that by pulling the chain 17 to rotate the pulley wheel 14, the degree of rotation will selectively position the positive contact conductor point 26 alternately on the conductor portion 15 or the insulator portion 16.

The positive contact conductor point 27 may be positioned to permanently contact the back section of the conductor plate 15 or be synchronized to contact the conductor portion 15*a* and 15*b* when the contact 26 is in contact with the conductor portion, or be in contact with the insulator portion 16 when the conductor point 26 is in contact with the insulator portion 16 of the conductor plate.

On malfunction of any of the movable parts or breaking of contact points, they may be easily, readily and inexpensively replaced.

In operation the device works the same as the conventional old pull chain sockets. The device of this invention, however is more durable and the parts replaceable upon failure, without destruction of the socket as a whole, as has been necessary in the prior art.

What is claimed is:

1. In a pull switch for lamp sockets, the combination of an insulator body formed of two parts, a rotatable pulley wheel mounted between said two parts of said insulator body, said pulley wheel having a central portion and two side flanges, ratchet teeth provided on the central portion of said rotatable pulley wheel, a pull chain having an enlarged bead adapted to engage said ratchet teeth to rotate said pulley wheel, a return spring for retracting said chain, a contact plate mounted on one of said flanges of said rotatable pulley wheel, alternating insulator portions and contact portions on said contact plate, removable conductor points mounted to one of the two parts of said insulator body and positioned to contact the conductor plate and alternatively make and break the electric circuit upon the conductor points being to contact with said central portions and said insulator portions respectively.

2. The device of claim 1 together with a second conductor mounted to the other of said two parts of the insulator body to complete the circuit.

3. The device of claim 1 together with an insulated housing member to receive said insulator body and the attachments thereto.

* * * * *